US008317553B2

(12) United States Patent
Nishide

(10) Patent No.: US 8,317,553 B2
(45) Date of Patent: Nov. 27, 2012

(54) TERMINAL FITTING WITH AN ENTRANCE PREVENTING WALL

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/079,952

(22) Filed: Apr. 5, 2011

(65) Prior Publication Data

US 2011/0250804 A1 Oct. 13, 2011

(30) Foreign Application Priority Data

Apr. 7, 2010 (JP) ..... 2010-088467

(51) Int. Cl.
*H01R 13/02* (2006.01)

(52) U.S. Cl. ..... 439/884

(58) Field of Classification Search ..... 439/81, 439/852, 888, 861, 739, 749, 438
See application file for complete search history.

(56) References Cited

U.S. PATENT DOCUMENTS

| | | | | |
|---|---|---|---|---|
| 3,621,445 | A * | 11/1971 | Horecky et al. | 439/81 |
| 3,748,634 | A * | 7/1973 | Barnes et al. | 439/852 |
| 5,989,080 | A | 11/1999 | Tsuji et al. | |
| 6,217,379 | B1 | 4/2001 | D'Hulster et al. | |
| 6,666,733 | B2 | 12/2003 | Takatsuki et al. | |
| 6,692,301 | B2 * | 2/2004 | Okayasu et al. | 439/587 |
| 6,890,192 | B2 * | 5/2005 | Riku | 439/108 |
| 7,118,429 | B1 * | 10/2006 | Fabian | 439/852 |
| 2007/0111612 | A1 | 5/2007 | Fabian et al. | |
| 2008/0146090 | A1 | 6/2008 | Shimizu | |

FOREIGN PATENT DOCUMENTS

DE 19539714 C1 12/1996

* cited by examiner

*Primary Examiner* — Chandrika Prasad
(74) *Attorney, Agent, or Firm* — Gerald E. Hespos; Michael J. Porco

(57) ABSTRACT

A terminal fitting (10) is provided with a box-shaped portion (12) in the form of a rectangular tube, a tab (11) projecting forward from the front end of the box-shaped portion (12), and a crimping portion (13) arranged behind and at a distance from the box-shaped portion (12) and to be crimped and connected to a wire (30). An entrance preventing wall (26) extending obliquely backward in a cantilever manner from an upper wall (23) constituting the box-shaped portion (12) is formed in the box-shaped portion (12).

14 Claims, 5 Drawing Sheets

TERMINAL FITTING WITH AN ENTRANCE PREVENTING WALL

BACKGROUND OF THE INVENTION

1. Field of the Invention

The invention relates to a male terminal fitting including a tab at its leading end.

2. Description of the Related Art

U.S. Pat. No. 6,666,733 discloses a male terminal fitting including a tab at its leading end. This terminal fitting has a box-shaped portion in the form of a rectangular tube connected to the rear end of the tab and a crimping portion in the form of an open barrel arranged behind the box-shaped portion. The box-shaped portion has an open rear end, and a tab of another terminal fitting may enter the box-shaped portion when a plurality of terminal fittings are transported or stored in a bundled state. If this occurs, there is a possibility that the tab cannot be pulled out or the tab and the box-shaped portion are deformed. As a countermeasure, an entrance preventing wall is provided to close an opening in the rear surface of the box-shaped portion in the terminal fitting of U.S. Pat. No. 6,666,733.

In the above terminal fitting, the entrance preventing wall is formed by bending a plate-like portion extending from the rear end edge of the upper wall of the box-shaped portion substantially at a right angle. However, a wire connected to the crimping portion is present behind the box-shaped portion. Thus, the tip of the tab presses the entrance preventing wall by contacting the entrance preventing wall obliquely. At this time, the tip of the tab is oriented toward an extending end of the entrance preventing wall and slides toward the extending end of the entrance preventing wall along the rear surface of the entrance preventing wall. The extending end of this entrance preventing wall is a free end not supported by another part. Thus, the entrance preventing wall is deformed obliquely forward by a pressing force from the tab, and the tab may enter the box-shaped portion.

The present invention was developed in view of the above situation and an object thereof is to reliably prevent the entrance of a tab into a box-shaped portion.

SUMMARY OF THE INVENTION

According to the invention, there is provided a terminal fitting, comprising: a tubular portion; a tab substantially projecting forward from the front end of the tubular portion, and a wire connection portion arranged behind and/or at a distance from the tubular portion and to be connected to a wire, wherein at least one entrance preventing wall substantially extending obliquely backward in a cantilever manner from a wall portion of the tubular portion is formed in or at the tubular portion.

If a tab of another terminal fitting obliquely approaches the tubular portion and comes into contact with the entrance preventing wall, it can slide on the entrance preventing wall toward a base end portion of the entrance preventing wall. Since the base end portion of the entrance preventing wall is connected to the wall portion and has high rigidity, it is not likely to be deformed and any further entrance of the tab can be reliably prevented.

According to a particular embodiment of the invention, there particularly is provided a terminal fitting, comprising a box-shaped portion in the form of a rectangular tube; a tab projecting forward from the front end of the box-shaped portion; and a crimping portion arranged behind and at a distance from the box-shaped portion and to be crimped and connected to a wire, wherein an entrance preventing wall extending obliquely backward in a cantilever manner from a wall portion constituting the box-shaped portion is formed in the box-shaped portion.

If a tab of another terminal fitting obliquely approaches the box-shaped portion from a rear side and comes into contact with the entrance preventing wall, it slides obliquely forward on the entrance preventing wall toward a base end portion of the entrance preventing wall. Since the base end portion of the entrance preventing wall is connected to the wall portion and has high rigidity, it is not likely to be deformed and any further entrance of the tab can be reliably prevented.

Particularly, an extending end of the entrance preventing wall is in contact with another wall portion of the tubular portion arranged to substantially face the wall portion or substantially faces the other wall portion with a clearance smaller than the thickness of the tab formed therebetween. Further particularly, an extending end of the entrance preventing wall is in contact with another wall portion of the box-shaped portion arranged to face the wall portion or faces the other wall portion with a clearance smaller than the thickness of the tab formed therebetween.

If an approach path of the tab to the box-shaped portion is directed toward the vicinity of the extending end of the entrance preventing wall, the tab may get into a clearance between the extending end of the entrance preventing wall and the other wall portion of the box-shaped portion arranged to face the wall portion. However, since the extending end of the entrance preventing wall is in contact with the other wall portion or faces the other wall portion with the clearance smaller than the thickness of the tab formed therebetween, it can be prevented that the tab gets into the clearance.

Particularly, a locking hole to be engaged with a locking lance for retaining the terminal fitting at least partly inserted in a cavity of a connector housing is formed in the tubular portion.

Further particularly, the locking hole is formed by cutting a part of the wall portion and bending the cut part, and the entrance preventing wall is formed by bending the cut part at least partly corresponding to an opening area of the locking hole.

Further particularly, a locking hole to be engaged with a locking lance for retaining the terminal fitting inserted in a cavity of a connector housing is formed in the box-shaped portion by cutting a part of the wall portion and bending the cut part; and the entrance preventing wall is formed by bending the cut part corresponding to an opening area of the locking hole.

If a part different from the locking hole is cut and bent to form an entrance preventing wall by a bent cut piece, the box-shaped portion is formed with an opening different from the locking hole and the strength of the box-shaped portion may be reduced. In this respect, in the present invention, the cut piece cut and bent to form the locking hole is effectively utilized as the entrance preventing wall. This obviates the need for forming an opening different from the locking hole, wherefore a reduction in the strength of the box-shaped portion resulting from the formation of the entrance preventing wall is prevented.

Particularly, the extending length of the entrance preventing wall is longer than the a diameter of the tubular portion.

Particularly, a base end portion of the entrance preventing wall and the wall portion are connected at an acute angle.

Particularly, a distal portion of the entrance preventing portion is arranged to be more backward than a base end portion of the entrance preventing wall where the entrance preventing wall is connected to the wall portion.

Particularly, an extending end of the entrance preventing wall is brought in contact with another wall portion of the tubular portion arranged to substantially face the wall portion or is positioned so as to substantially face the other wall portion with a clearance smaller than the thickness of the tab formed therebetween.

Particularly, the method further comprises forming a locking hole to be engaged with a locking lance for retaining the terminal fitting at least partly inserted in a cavity of a connector housing in the tubular portion.

Particularly, the locking hole is formed by cutting a part of the wall portion and bending the cut part, and the entrance preventing wall is formed by bending the cut part at least partly corresponding to an opening area of the locking hole.

Particularly, the extending length of the entrance preventing wall is set to be longer than the a diameter of the tubular portion.

Particularly, a base end portion of the entrance preventing wall and the wall portion are connected at an acute angle.

Particularly, a distal portion of the entrance preventing portion is arranged to be more backward than a base end portion of the entrance preventing wall where the entrance preventing wall is connected to the wall portion.

These and other objects, features and advantages of the invention will become more apparent upon reading of the following detailed description of preferred embodiments and accompanying drawings.

DETAILED DESCRIPTION OF THE PREFERRED EMBODIMENTS

Figure 1:
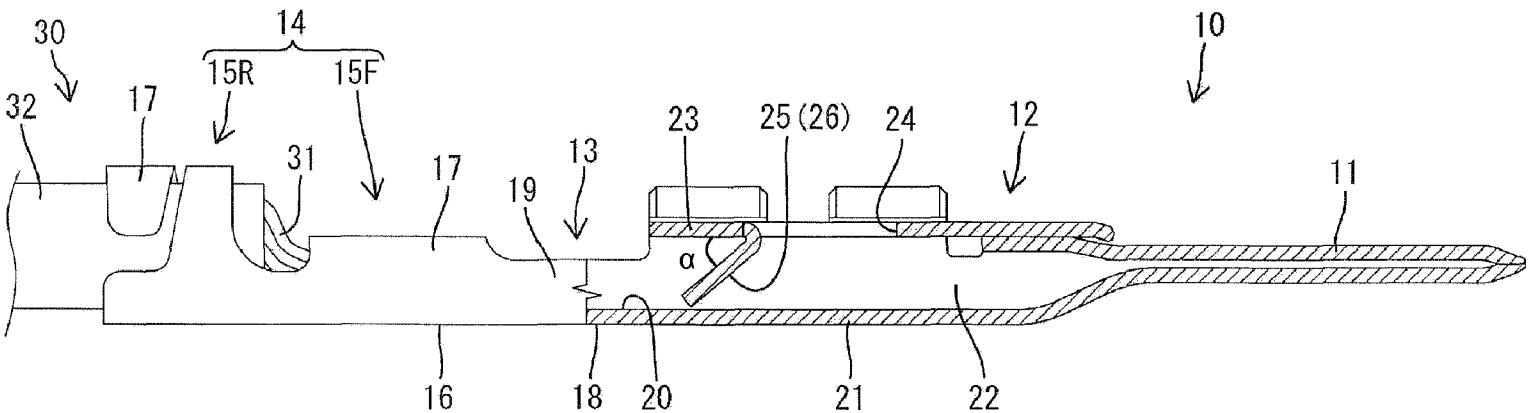
FIG. 1 is a side view partly in section of a terminal fitting according to one embodiment.
Figure 2:
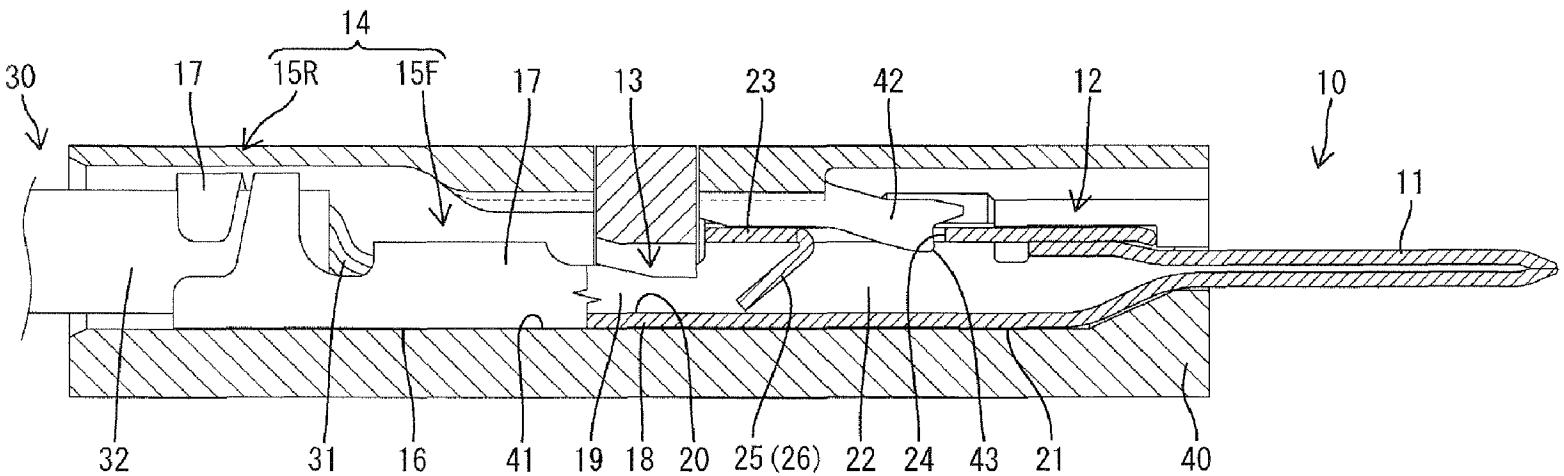
FIG. 2 is a section showing a state where the terminal fitting is inserted in a connector housing.
Figure 3:
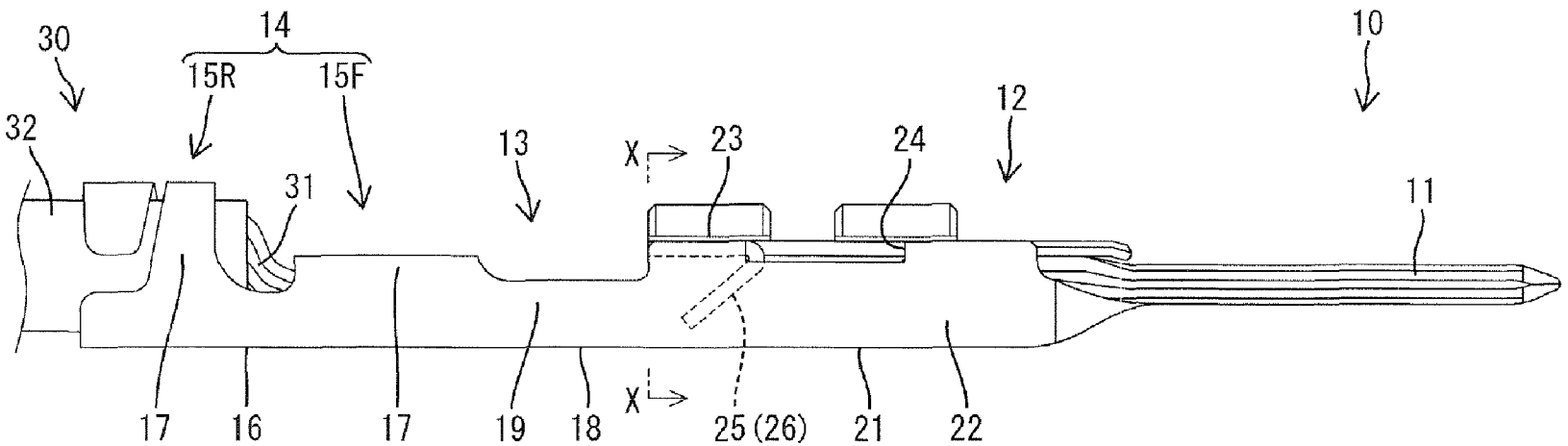
FIG. 3 is a side view of the terminal fitting.
Figure 4:
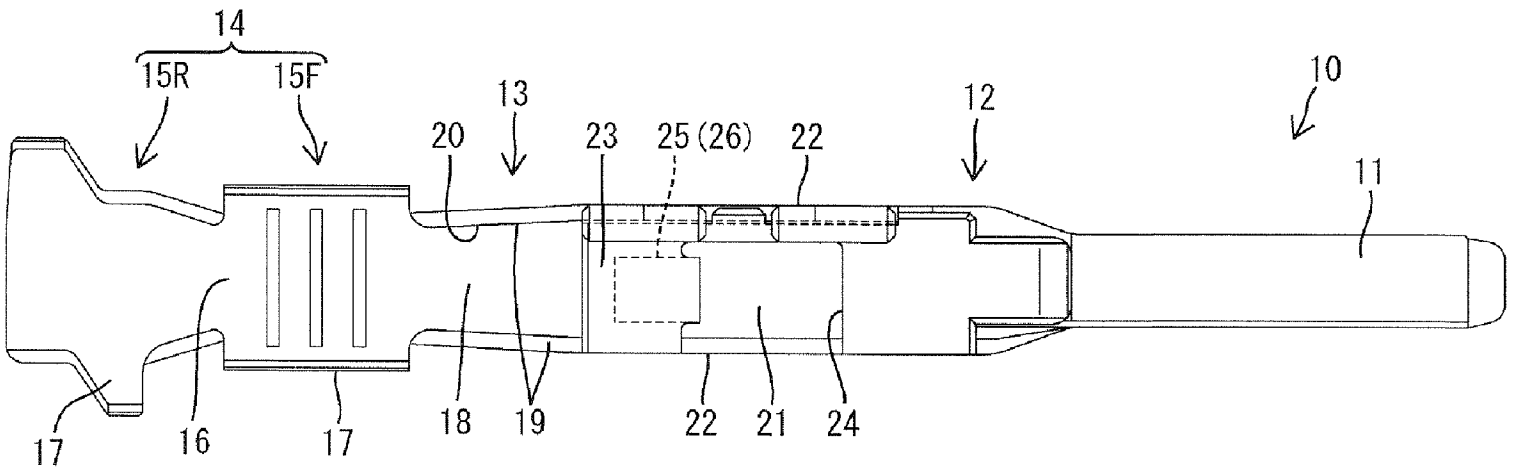
FIG. 4 is a plan view of the terminal fitting.
Figure 5:
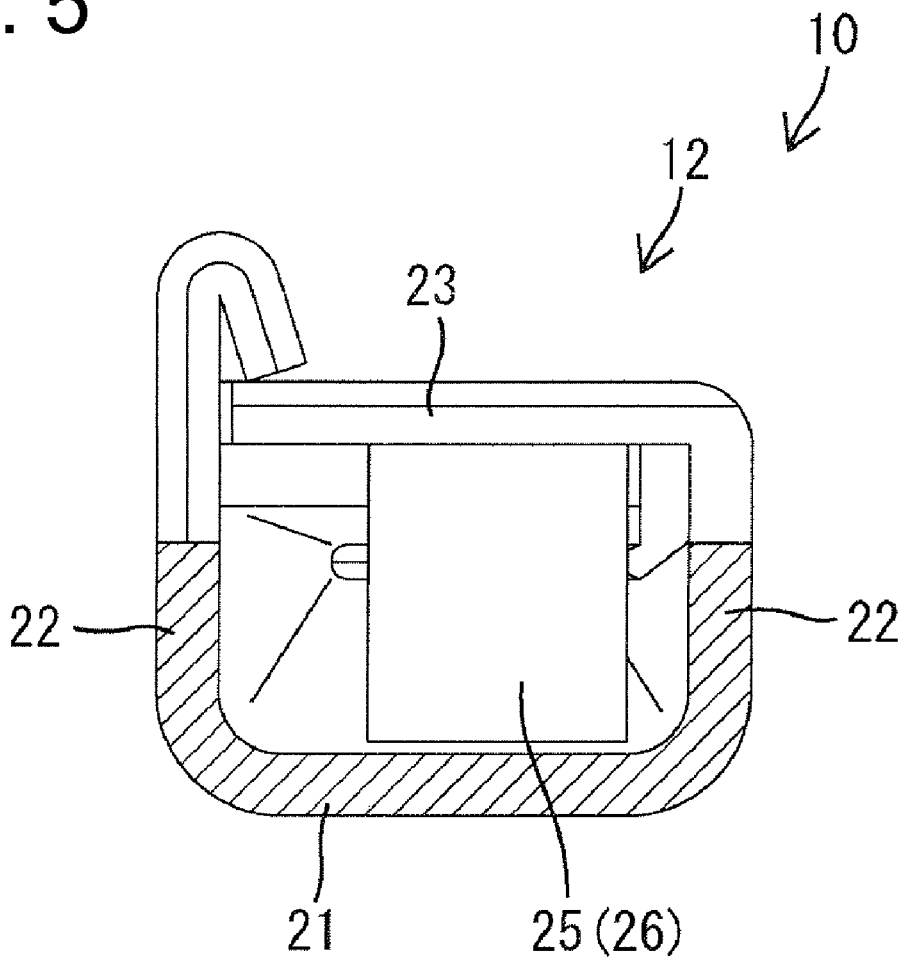
FIG. 5 is an enlarged section along X-X of FIG. 3.

A male terminal fitting 10 in accordance with an embodiment of the invention is long and narrow in forward and backward directions and includes a tab 11 at its leading end. The terminal fitting 10 is formed by bending, folding and/or embossing a conductive metal plate material that has been cut or punched out into a specified shape and includes a substantially box-shaped portion 12, a coupling 13 connected to the rear end (left end in FIGS. 1 to 4) of the box-shaped portion 12 and a wire crimping portion 14 in the form of an open barrel connected to the rear end of the coupling 13. The wire crimping portion is to be connected to an end of the wire, e.g. by crimping, but could be configured for connection by soldering, press-fitting, insulation displacement or the like. The tab 11 projects forward from the front end of the box-shaped portion 12.

The crimping portion 14 has a wire barrel 15F and an insulation barrel 15R connected to the rear end of the wire barrel 15F. The wire barrel 15F and the insulation barrel 15R have known shapes with crimping pieces 17 projecting from opposite left and right edges of a base plate 16. A core 31 exposed at a front end portion of a wire 30 is fixed electrically fixed to the wire barrel 15F by crimping, bending or folding, and the front end portion of the wire 30 in an area covered by an insulation coating 32 is fixed to the insulation barrel 15R by crimping, bending or folding.

The coupling 13 comprises a bottom wall 18 connected to the base plate portion 16 of the crimping portion 14 and side walls 19 projecting angularly from opposite left and right edges of the bottom wall 18 and connected to the crimping pieces 17 of the wire barrel 15F. The interior of the coupling 13 defines a communication space 20 that has an open top (opposite to or facing the bottom wall 18 and the base plate 16) and communicates with the internal space of the box-shaped portion 12.

The box-shaped portion 12 is a substantially rectangular tube with a lower wall 21 connected to the bottom wall 18 of the coupling 13, side walls 22 projecting up at substantially right angles from opposite left and right edges of the lower wall 21, and an upper wall 23 extending substantially parallel with the lower wall 21 from the upper end edge of one side wall 22. The lower wall 21, the upper wall 23 and the one side wall 22 are connected to the tab 11. The box-shaped portion 12 is formed with at least one locking hole 24 formed by cutting a part of the upper wall 23 and bending the cut part. The locking hole 24 penetrates from the upper surface to the lower surface of the upper wall 23, and a locking lance 42 is to be engaged with the locking hole 24.

A cut piece 25 is cut as the locking hole 24 to cantilever from the upper wall 23 at the rear edge of the locking hole 24. The cut piece 25 is a substantially rectangular plate substantially corresponding to an opening area of the locking hole 24 and functions as an entrance preventing wall 26 for preventing a tab 11 of another terminal fitting 10 from being deeply inserted into the box-shaped portion 12. The entrance preventing wall 26 is a substantially flat plate whose base end is connected to the upper wall 23 at the rear edge of the locking hole 24 and extends obliquely down to the back from the rear edge of the locking hole 24.

A dimension of the entrance preventing wall 26 in its extending direction is larger than a distance between the upper wall 23 and the lower wall 21 in a facing direction (vertical direction), and an extending end edge of the entrance preventing wall 26 is in contact with the upper surface of the lower wall 21. This contact position is in the box-shaped portion 12, i.e. before the rear end edge of the box-shaped portion 12. Further, the upper or base end of the entrance preventing wall 26 and the upper wall 23 are connected at an acute angle $\alpha$when viewed sideways. The distal portion of the entrance preventing portion 26 is more backward than the base end of the entrance preventing wall 26 where the entrance preventing wall 26 is connected to the upper wall 23.

The terminal fitting 10 is inserted into a cavity 41 in a connector housing 40 from behind. A locking lance 42 is cantilevered forward along an inner wall of the cavity 41. The locking lance 42 normally is held at a locking position shown in FIG. 2 due to the rigidity of the locking lance 42, but is resiliently displaceable from the locking position to an unlocking position offset from the cavity 42. A locking projection 43 is formed on the inner surface of the locking lance 42. The locking projection 43 interferes with an outer surface of the box-shaped portion 12 as the terminal fitting 10 is inserted into the cavity 41. Thus, the locking lance 42 is displaced to the unlocking position. The locking lance 42 resiliently restores when the terminal fitting 10 is inserted properly so that the locking projection 43 engages the locking hole 24 to retain the terminal fitting 10.

The locking projection 43 is to be engaged with the front edge of the locking hole 24 opposite to the rear edge connected to the entrance preventing wall 26. The rear edge of the locking hole 24 has a curved surface where the cut piece 25 (entrance preventing wall 26) is bent. Thus, even if the locking projection 43 engaged this rear edge, a locking force is small. In contrast, the front edge of the locking hole 24 is a part punched by a press upon forming the cut piece 25 (entrance preventing wall 26). Thus, a locking force is large when the locking projection 43 engaged this cut front edge.

A plurality of terminal fittings 10 are transported stored or manipulated e.g. in a bundled state. Thus, the tab 11 of one terminal fitting 10 may enter the communication space 20 of the box-shaped portion 12 of another terminal fitting 10 obliquely from a rear upper side and further enter the interior of the box-shaped portion 12. However, even if the tab 11 slightly enters, the tip of the tab 11 contacts the rear surface of the entrance preventing wall 26 to prevent any further entrance of the tab 11 into the box-shaped portion 12.

The entrance preventing wall 26 extends obliquely up to the front toward the upper wall 23. Thus, the tab 11 that contacts the entrance preventing wall 26 slides obliquely up to the front along the rear surface of the entrance preventing wall 26. The contact position of the tab 11 on the entrance preventing wall 26 approaches the base end portion (upper wall 23) of the entrance preventing wall 26 by this sliding movement. The base end portion of the entrance preventing wall 26 is connected to the upper wall 23. Thus, the rigidity of the entrance preventing wall 26 increases toward the base end portion. Accordingly, even if a force of the tab 11 pressing the entrance preventing wall 26 is strong, there is no likelihood of deforming the entrance preventing wall 26 and the entrance of the tab 11 into the box-shaped portion 12 can be prevented reliably.

The tab 11 may be held in contact with the free end portion of the entrance preventing wall 26 without sliding obliquely up to the front. Thus, the entrance preventing wall 26 may be deformed to pivot forward with the base end portion at the upper wall 23 as a support. However, the extending length of the entrance preventing wall 26 is longer than the distance between the upper wall 23 and the lower wall 21 and the extending end edge of the entrance preventing wall 26 contacts the lower wall 21. Thus, there is no likelihood that the entrance preventing wall 26 is deformed to pivot forward.

If an approach path of the tab 11 to the box-shaped portion 12 is directed toward the vicinity of the extending end of the entrance preventing wall 26, the tab 11 may get into a clearance between the extending end of the entrance preventing wall 26 and the lower wall 21. However, the extending end of the entrance preventing wall 26 particularly is in contact with the lower wall 21 and there is no clearance between the extending end edge of the entrance preventing wall 26 and the lower wall 21. Thus, there is no likelihood that the tab 11 gets into the clearance.

If a part different from the locking hole is cut and bent to form an entrance preventing wall 26 by a resulting cut piece 25, the box-shaped portion 12 is formed with an opening different from the locking hole 24 and the strength of the box-shaped portion 12 may be reduced. However, the entrance preventing wall 26 is formed by bending the cut or separated piece 25 corresponding to the opening area of the locking hole 24, focusing on the fact that the locking hole 24 to be engaged with the locking lance 42 for retaining the terminal fitting inserted in the cavity 41 of the connector housing 40 is formed in the box-shaped portion 12 by cutting and bending a part of the wall. In other words, the cut piece 25 cut and bent to form the locking hole 24 is utilized as the entrance preventing wall 26. This obviates the need for forming an opening different from the locking hole 24, and the strength of the box-shaped portion 12 resulting from the formation of the entrance preventing wall 26 is not reduced.

The invention is not limited to the above described and illustrated embodiment. For example, the following embodiments are also included in the technical scope of the present invention.

Although the entrance preventing wall extends from the upper wall (i.e. wall portion opposite to the lower wall connected to the base plate portion of the crimping portion) of the box-shaped portion in the above embodiment, it may extend from the lower wall or left or right side wall of the box-shaped portion.

Although one entrance preventing wall is formed in the box-shaped portion in the above embodiment, a plurality of entrance preventing walls may be formed in one box-shaped portion. In this case, a plurality of entrance preventing walls may particularly extend from the same wall portion or may extend from different wall portions.

Although the extending end of the entrance preventing wall is in contact with the lower wall arranged to substantially face the upper wall in the above embodiment, it may face the lower wall with a clearance smaller than the thickness of the tab formed therebetween.

Although the entrance preventing wall is formed by bending the cut piece formed as the locking hole is formed, a part different from the locking hole may be cut and an entrance preventing wall may be formed by this cut part.

What is claimed is:

1. A terminal fitting, comprising:

a tubular portion having a front end, an open rear end, and opposed first and second walls, a locking hole formed in the first wall of the tubular portion, the locking hole having a front edge for engaging a locking lance for retaining the terminal fitting inserted in a cavity of a housing, the locking hole further having a rear edge opposite the front edge and between the front edge and the rear end of the tubular portion;

a tab substantially projecting forward from the front end of the tubular portion;

a wire connection portion arranged behind the tubular portion and configured for connection to a wire; and at least one entrance preventing wall bent through an angle of more than 90° to cantilever obliquely rearward from a position of the first wall of the tubular portion at the rear edge of the locking hole and defining an acute angle with portions of the first wall adjacent the open rear end.

2. The terminal fitting of claim 1, wherein an extending end of the entrance preventing wall contacts the second wall of the tubular portion or faces the second wall with a clearance smaller than the thickness of the tab formed therebetween.

3. The terminal fitting of claim 1, wherein an extending length of the entrance preventing wall is longer than a distance between the first and second walls of the tubular portion to limit forward rotation of the entrance preventing wall.

4. The terminal fitting of claim 1, wherein a distal portion of the entrance preventing wall is more backward than a base end portion of the entrance preventing wall where the entrance preventing wall is connected to the first wall of the tubular portion.

5. The terminal fitting of claim 1, wherein the entrance preventing wall is disposed entirely within the tubular portion.

6. The terminal fitting of claim 1, wherein a distal portion of the entrance preventing wall is disposed between the first and second walls of the tubular portion.

7. The terminal fitting of claim 1, wherein the second wall of the tubular portion is free of openings opposed to the entrance preventing wall.

8. A terminal fitting, comprising:

a tubular portion having a front end, an open rear end, and opposed first and second walls;

a tab projecting forward from the front end of the tubular portion;

a wire connection portion arranged behind the tubular portion and configured for connection to a wire; and an entrance preventing wall unitary with the first wall at a position spaced from the front and rear ends of the tubular portion, the entrance preventing wall being bent rearward through an angle of more than 90° about a bend line substantially normal to a front to rear direction so that the entrance preventing wall cantilevers obliquely rearward from a position on the first wall of the tubular portion forward of the open rear end and defines an acute angle with portions of the first wall adjacent the open rear end, all of the entrance preventing wall being between the first and second walls and a locking hole being defined in the first wall between the bend line of the entrance preventing wall and the front end of the tubular portion.

9. The terminal fitting of claim 8, wherein a rear end of the entrance preventing wall is substantially in contact with the second wall of the tubular portion.

10. A terminal fitting having opposite front and rear ends, the terminal fitting comprising:

a tab adjacent the front end of the terminal fitting;

a wire connection portion adjacent the rear end of the terminal fitting and configured for connection to a wire; and a tubular portion between the tab and the wire connection portion, the tubular portion having a front end, an open rear end, and opposed first and second walls, a locking hole being formed in the first wall of the tubular portion for engaging a locking lance for retaining the terminal fitting inserted in a cavity of a housing, the locking hole being formed by cutting a part of the first wall and bending the cut part through an angle of more than 90° degrees to form an entrance preventing wall cantilevered obliquely rearward from a bend line on the first wall adjacent to the locking hole and on a side of the locking hole closer to the open rear end of the tubular portion, whereby the entrance preventing wall prevents a tab of another terminal fitting from inadvertently becoming engaged in the open rear end of the tubular portion.

11. The terminal fitting of claim 10, wherein the entrance preventing wall is disposed entirely within the tubular portion.

12. The terminal fitting of claim 10, wherein a distal portion of the entrance preventing wall is disposed between the first and second walls of the tubular portion.

13. The terminal fitting of claim 10, wherein the second wall of the tubular portion is free of openings opposed to the entrance preventing wall.

14. The terminal fitting of claim 10, wherein an extending length of the entrance preventing wall is exceeds a distance between the first and second walls of the tubular portion to limit forward rotation of the entrance preventing wall.

* * * * *